US006390115B1

(12) United States Patent
Rohwer et al.

(10) Patent No.: US 6,390,115 B1
(45) Date of Patent: May 21, 2002

(54) METHOD AND DEVICE FOR PRODUCING A DIRECTED GAS JET

(75) Inventors: Egmont Rohwer, Lynnrodene (ZA); Ralf Zimmermann, Munich (DE); Hans Jörg Heger, Munich (DE); Ralph Dorfner, Munich (DE); Ulrich Boesl, Landshut (DE); Antonius Kettrup, Ansberg (DE)

(73) Assignee: GSF-Forschungszentrum für Umwelt und Gesundheit, Oberschleissheim (DE)

( * ) Notice: Subject to any disclaimer, the term of this patent is extended or adjusted under 35 U.S.C. 154(b) by 38 days.

(21) Appl. No.: 09/722,445

(22) Filed: Nov. 17, 2000

Related U.S. Application Data

(63) Continuation-in-part of application No. PCT/EP99/03419, filed on May 18, 1999.

(30) Foreign Application Priority Data

May 20, 1998 (DE) ..... 198 22 672

(51) Int. Cl.[7] ..... B01F 3/02; B01F 5/04

(52) U.S. Cl. ..... 137/3; 137/606; 137/607; 250/288

(58) Field of Search ..... 137/3, 889, 606, 137/607; 250/288

(56) References Cited

U.S. PATENT DOCUMENTS 4,938,256 A * 7/1990 Wiegleb et al. ..... 137/607
5,311,016 A * 5/1994 Villa-Aleman ..... 250/288
5,345,079 A * 9/1994 French et al. ..... 250/288
5,536,323 A * 7/1996 Kirlin et al. ..... 118/726
5,742,050 A 4/1998 Amirav et al. ..... 250/288

FOREIGN PATENT DOCUMENTS

DE 44 41 972 8/1996
EP 0 770 870 5/1997

OTHER PUBLICATIONS

Chung Hang Sin et al., "Supercritical Fluid/Supersonic Jet Spectroscopy with a Sheath–Flow Nozzle", *Analytical Chemistry*, vol. 64, No. 2, Jan. 15, 1992pp. 233–238.

* cited by examiner

*Primary Examiner*—Stephen M. Hepperle
(74) *Attorney, Agent, or Firm*—Klaus J. Bach

(57) ABSTRACT

In a method for producing a directed gas jet wherein a guided sample gas beam is generated and an auxiliary gas beam is generated and directed and guided in the same direction as, but separated from, the sample gas beam, a pulsed carrier gas stream is generated and combined with the sample gas beam such that the sample gas beam is separated into spaced pulses which are embedded between the axially spaced pulses of the carrier gas beam and the carrier gas beam with the sample gas beam embedded therein is combined with the auxiliary gas beam such that the carrier and sample gas beam is radially enveloped by the auxiliary gas beam to from the directed gas jet of a carrier and sample gas pulses enveloped in the auxiliary gas beam.

16 Claims, 2 Drawing Sheets

METHOD AND DEVICE FOR PRODUCING A DIRECTED GAS JET

This is a continuation-in-part application of international application PCT/EP99/03419 filed May 18, 1999 and claiming the priority of German application 198 22 672.1 filed May 20, 1998.

BACKGROUND OF THE INVENTION

The invention relates to a method and a device for producing a directed gas jet as they are known from Chun Hang Sin et al. "Supercritical Fluid/Supersonic Jet Spectroscopy with a Sheath-Flow Nozzle", Analytical Chemistry, Vol 64, No. 2, Jan. 15, 1992 (1992-01-15), pages 233–238, XP000248258 ISSN: 0003-2700.

A fast on-line analysis for gaseuos samples is desirable in many areas of research but also in the industry. It could be used for research, for the surveillance of exhaust gases, waste combustion plants, roasting gases during roasting of coffee, headspace analysis of mineral oils and soil samples. The information received therefrom can be used as a parameter for the process control. Of particular interest are often the compounds with aromatic base structures such as polycyclical aromatic hydrocarbons (PAH) in exhaust gases of industrial combustion plants. Since different isomers of the various PAH have different environmental relevance or, respectively, toxicity, it is reasonable to detect them selectively.

For a rapid on-line analysis of gaseous samples, molecule-spectroscopic procedures using the supersonic molecule beam technique are particularly suitable. In this procedure, the sample gas beam is adiabatically expanded into a vacuum, which results in a reduction of the internal energy of the sample molecules. This reduction of the internal energy results in a reduction of the temperature, that is, the sample molecules are cooled by the adiabatic expansion. As a result, the energy bands become narrower and do not overlap—in contrast to samples, which have not been cooled. Since the energy required for the excitation of the molecules is different for different compounds and also for different isomers of a compound, the energy needed for the excitation of the molecules can be used for an isomer-selective identification. For example, by the excitation and subsequent photo-ionization (REMPI) by means of a narrow band laser, a very high optical selectively can be achieved in this way up to an isomer selectivity.

Generally, the supersonic molecule beam or jet is generated by the expansion of a continuous or a pulsed gas beam through a small nozzle into a vacuum. This method has been used so for mainly for spectroscopic examinations where the detection sensitivity does not play any role. Since, during expansion, the sample beam becomes rapidly wider, which results in a large reduction of the sample density, the achievable detection sensitivity is noticeably worse than with alternative inlet techniques such as an effusive gas inlet wherein the sample molecules are not cooled. The utilization of the selective supersonic molecule beam technique in the on-line analysis is therefore aimed at an improvement in the detection sensitivity.

A proposal herefor is offered in the article by S. W. Stiller and M. V. Johnston: "Supersonic Jet Spectroscopy with a Capillary Gas Chromatographic Inlet", Anal. Chem. 1987, 59, 567–572. Stiller and Johnston developed a coupling of gas chromatography (GC) and laser-induced fluorescence spectroscopy (LIF) with supersonic molecular beam techniques (JET). To this end, they use an arrangement, wherein a GC capillary extends into the center of a concentric guide tube for an auxiliary gas beam. The sample gas supplied by way of the capillary is added into the core (center axis) of the auxiliary gas beam. The auxiliary gas beam and the sample gas beam centered in the auxiliary gas beam focussed along the center axis thereof are continuously expanded into a vacuum through a nozzle with a narrowed tip, whereby a continuous supersonic molecule beam is formed.

The adiabatic expansion of the gas beam into the vacuum results in a cooling of the auxiliary gas and the sample gas molecules. As a result of the adiabatic cooling more sharply defined bands for the excited states of the molecules are generated. With a sharply defined energy (laser wavelength), then only certain sample molecules can be excited, which provides for a high optical selectivity. With the high optical selectivity, the sample molecules can partially be detected even in an isomer-selective manner.

The concentric narrowing down of the gas beam guide tube toward the tip opening into the vacuum chamber causes an additional focussing of the sample gas beam onto the center axis of the auxiliary gas beam so that the expansion into the vacuum results in a delayed spatial expansion of the sample gas beam. With the subsequent ionization or fluorescence excitation, a larger part of the sample molecules can be irradiated (higher sensitivity) without the need for a reduction of the effective cross-section for the excitation or, respectively, ionization by a spatial expansion of the laser beam (lower power density).

Although the sample gas density in the excitation or, respectively, ionization volume can be increased with the arrangement as described by Stiller and Johnston, the high-vacuum conditions are detrimentally affected by the continuous gas beam to such a degree that collisions between the sample molecules and, respectively, the auxiliary gas molecules make sensible measurements impossible. Furthermore, a large part of the sample gas, which passes between the laser pulses and which is not ionized and can therefore not be detected, is wasted.

Another apparatus for improving the detection sensitivity by employing the supersonic molecular beam technique is described by B. V. Pepich, J. B. Callis, J. D. Sheldon Danielson and M. Gouterman in the article: "Pulsed free jet expansion system for high-resolution fluorescence spectroscopy of capillary gas chromatographic effluents", Rev. Sci. Instrum. 57(5), 1986, 878–887. Pepich et al. represent therein a GC-supersonic molecular beam coupling for the laser-induced fluorescence spectroscopy. As a result of the pulsed inlet, among others, a first increase of the sample volume employed for the analysis in comparison with the effusive inlet system is achieved. In order not to interrupt the GC flow by the pulsed inlet, Pepich proposes to introduce the sample into a pre-chamber in an effusive manner. Into this pre-chamber, a pulsed carrier gas is injected, which also provides for the gas flow needed for the expansion cooling. This carrier gas compresses the sample gas in the pre-chamber and pushes it, like a piston, through a small opening downwardly into an optical chamber where the fluorescence excitation takes place. As a result of the pulsed compression and injection of the sample gases into the optical chamber, a larger number of sample molecules can be reached by the subsequent laser excitation (increase of the detection sensitivity). The opening of the valves and the laser pulses must be synchronized in order for the compressed sample gas pulse to be excited by the laser pulse.

With the supersonic molecular beam technique an adiabatic cooling of the sample is achieved, whereby the selectivity of the method is substantially increased.

The setup selected by Pepich et al. facilitates also a repetitive, timely limited compressions of the sample in gas flow direction and improves the detection sensitivity also for this reason. However, it does not prevent the rapid spatial expansion of the sample gases which is typical for the supersonic molecular beam technique and as a result of which a large part of the sample gas is outside the ionization volume when excitation or ionization takes place. A widening of the laser beam is again not feasible because of the deterioration of the effective ionization cross-section.

It is the object of the present invention to provide a method and apparatus of the type described above wherein however a maximum particle density can be generated.

SUMMARY OF THE INVENTION

In a method for producing a directed gas jet wherein a guided sample gas beam is generated and an auxiliary gas beam is generated and directed and guided in the same direction as, but separated from, the sample gas beam, a pulsed carrier gas stream is generated and combined with the sample gas beam such that the sample gas beam is separated into spaced pulses which are embedded between the axially spaced pulses of the carrier gas beam and the carrier gas beam with the sample gas beam embedded therein is combined with the auxiliary gas beam such that the carrier and sample gas beam is radially enveloped by the auxiliary gas beam to from the directed gas jet of a carrier and sample gas pulses enveloped in the auxiliary gas beam.

The oriented guided auxiliary gas beam remains separate from the sample gas beam but extends in the same direction and both beams are combined over a certain distance. The lengths of the auxiliary gas and the sample gas beam guidance and the length for their combination needs to be adapted to the respective requirements. With an extended distance for the combination of the two gas beams (several centimeter), the sample gas and auxiliary gas are mixed to a greater degree than with a shorter distance (several millimeter). Depending on whether a mixing is desired or such mixing is to be avoided, the length for the combination of the gas beams must be differently selected.

In accordance with the method according to the invention, it is advantageous if the auxiliary gas beam is pulsed. In this way, the best possible high vacuum conditions can be maintained and the sample molecules are not detrimentally affected by collisions among themselves or with auxiliary gas molecules.

It is advantageous if, after a certain distance of combined flow, the gas beam is narrowed in its cross-section. In this way, a rapid spatial expansion of the sample gas in the ionization chamber is avoided and—as explained above—a larger part of the sample is ionized which results in an increased sensitivity. If the sample gas beam is combined with the auxiliary gas beam along the center axis of the auxiliary gas beam, the narrowing cross-section improves the focussing (transverse to the flow direction) of the sample gas along the center axis of the auxiliary gas beam (higher density of sample molecules). With a focussing of the laser beam on the center axis of the auxiliary gas beam, a substantial sensitivity increase is achieved by a combination of an increased laser power density at the ionization location and an increased sample gas density in the ionization volume.

It is particularly advantageous if the sample gas beam is embedded in a pulsed carrier gas beam since, in this case, the sample gas beam is compressed also in the flow direction of the gas beam. When this compressed sample gas pulse enters the ionization volume, a larger part of the sample gas molecules is ionized with each laser pulse, which results in a more effective utilization of the introduced sample gas amount and consequently in an increase of the sensitivity.

Preferably, the pulses of the carrier gas beam and of the auxiliary gas beam are correlated such that an advantageous position of the compressed sample gas pulse in the carrier gas pulse is obtained. In this way, an optimal combination of the compression of the sample by the carrier gas pulse in the gas beam flow direction and the compression of the sample by the auxiliary gas flow in a direction transverse to the flow direction can be achieved. As a result, the sample volume can be approximated the ionization volume in the laser beam. With an additional time-synchronization of the gas pulses with the laser pulse, the sample pulse can be controlled so as to be in the ionization chamber exactly at the point in time when the laser pulse illuminates the ionization volume. In this way, no sample molecules are wasted between the laser pulses (if sample molecules are not ionized, they are lost for the detection procedure). This results in a maximal utilization of the sample volume introduced and, consequently, in a substantial increase of the sensitivity when compared with conventional pulsed supersonic molecular beam inlet techniques.

It is advantageous if, after a reduction of the flow cross-section, the gas beam is expanded into a vacuum. Because of the reduction in the flow cross-section, even relatively small volume flows and gas reservoir pressures are sufficient to form a supersonic molecular beam. In this supersonic molecular gas beam, an adiabatic expansion of the gas beam occurs whereby the gas molecules are cooled which, as explained earlier, increases the optical selectivity of the process.

A narrowing of the sample gas tube ahead of its exit into the auxiliary gas guide tube is on one hand advantageous for the compression of the sample gas since, upon introduction of the pulsed carrier gas, the sample is backed up at its discharge opening into the auxiliary gas guide tube and is not pushed into the auxiliary gas beam. The backing up however results in a slower emptying of the sample gas tube whereby a time-wise longer sample gas pulse is generated. On the other hand, the narrowed guide tube provides for a focussing of the sample gas beam on the center axis of the auxiliary gas beam.

The narrowing of the sample gas beam and/or the combined gas beam can be achieved in different ways. For the combination of the beams, constrictions in the form of Laval or Venturi nozzles were found to be advantageous. It is possible to use different nozzle forms for the orifice of the sample gas guide tube into the auxiliary gas guide tube and the orifice of the auxiliary gas guide tube into the vacuum.

It is also advantageous to use a nozzle as the orifice for the auxiliary gas guide tube to the vacuum, which consists of an electrically non-conductive material.

In a preferred embodiment of the method according to the invention inert materials such as quartz glass are used on the surfaces of all gas guide tubes with which sample gas comes into contact. In this way, catalytic processes, which could lead to a change of the sample composition, can be avoided.

It is further advantageous for the method according to the invention if the whole sample gas guide structure up to the outlet orifice into the vacuum chamber can be heated so that memory effects caused by condensation of sample gas components on the guide tube walls and supply line walls are prevented.

The object according to the invention is further solved by an arrangement for generating a directed gas beam, wherein a guided sample gas beam and a directed guided auxiliary gas beam, which extends in the same direction as the sample gas beam but is separated therefrom, is generated and the sample gas beam is subsequently conducted with the auxiliary gas beam together over a certain distance.

The device according to the invention has the advantage that the sample gas beam is so contained in the auxiliary gas beam that it is guided along the center axis of the auxiliary gas beam whereby a rapid spatial expansion of the sample gas beam during expansion into a vacuum is substantially prevented.

An embodiment of the invention will be described below on the basis of the accompanying drawings.

DESCRIPTION OF A PREFERRED EMBODIMENT

Figure 1:
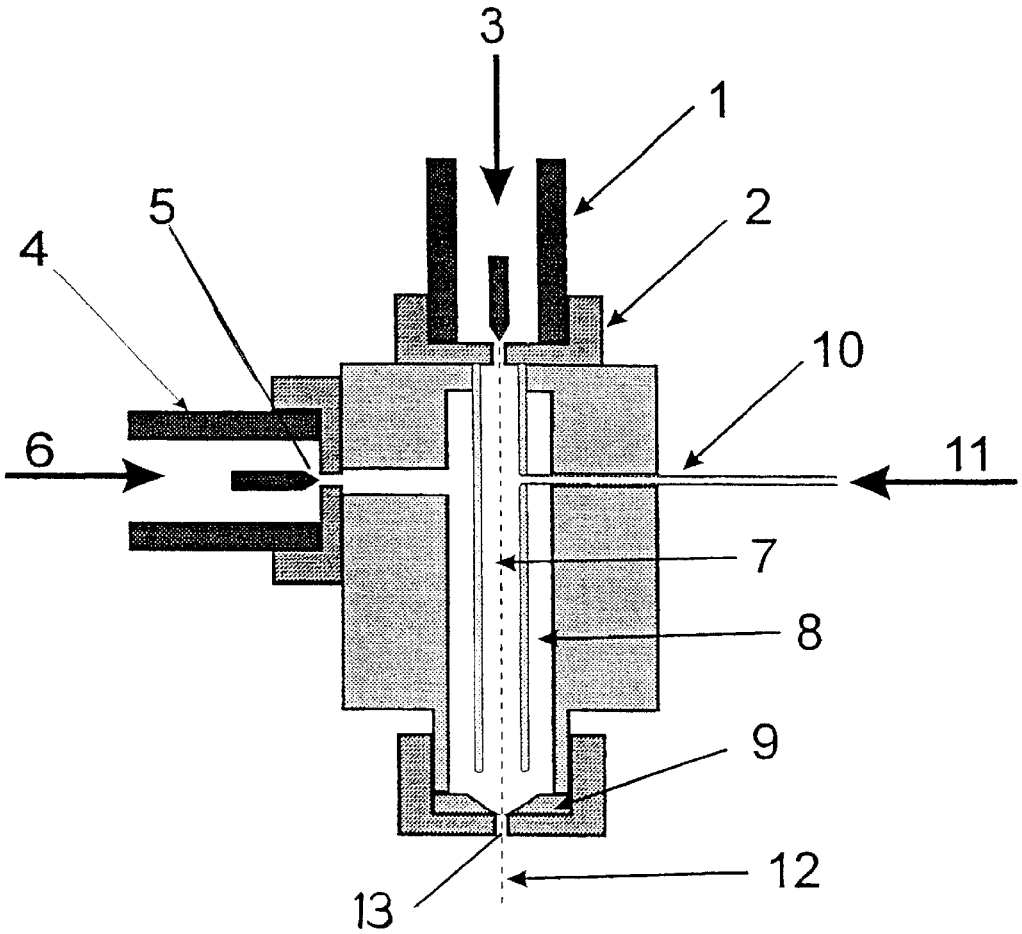
FIG. 1 is a cross-sectional view of a device according to the invention for generating a directed gas beam. The gas supply lines and the ion source are not shown.

An advantageous embodiment of the device according to the invention, wherein a gas beam of a sample gas 11 is embedded in a beam of an auxiliary gas 6, consists of a central sample gas guide tube 7 with a supply line and an auxiliary gas guide tube 8, which is also provided with a supply line and which centrally surrounds the sample gas guide tube 7. The sample gas guide tube 7 terminates in the auxiliary gas guide tube 8. The auxiliary gas 6 is supplied to the auxiliary gas guide tube 8 by way of a pulse valve 4 with a pulse valve nozzle 5 disposed in the supply line for the auxiliary gas 6. The auxiliary gas 6, a carrier gas 3 and the sample gas 11 are conducted to a vacuum by way of a gas outlet 13 of the device.

A constriction forming the outlet 13 at the end of the auxiliary gas guide tube 8 where the sample gas guide tube 7 ends is highly advantageous. In this way, a supersonic molecular beam can form upon expansion of the gas beam into the vacuum already with a relatively low gas reservoir pressure and a low volume flow (important for the maintenance of good vacuum conditions). With the expansion of the gas beam into a vacuum, the gas sample is adiabatically cooled whereby the optical selectivity during photoionization or absorption processes is increased. The constriction at the end of the auxiliary gas guide tube 8, where the sample gas tube 7 ends, further constricts the combined gas beam and, as a result, provides for a slower spatial expansion of the gas beam during expansion into the vacuum. In this way, a higher sample density in the ionization volume and therefore an increase in the detection sensitivity are achieved.

A compression of the sample gas 11 in the flow direction is achieved by a pulse valve 1 with a pulse valve nozzle 2 for generating gas pulses of the carrier gas 3 in the sample gas guide tube 7. By compression of the sample gas 11, the density of the sample gas molecules in illumination volume of the laser beam and, as a result, the detection sensitivity can be increased. In order not to interrupt the sample flow during this procedure, the sample gas 11 may be added by way of an auxiliary line 10 which extends into the sample gas guide tube 7.

With a programmable control unit for the two pulse valves 1 and 4, the pulses of the carrier gas 3 and the auxiliary gas 6 can be synchronized in such a way that an optimal combination of compression of the sample gas 11 in the flow direction and transverse to the flow direction can be achieved. In this way, the spatial expansion of the sample gas volume can be adapted to the ionization volume, which is given mainly by the laser beam cross-section.

A constriction of the sample gas guide tube 7 (not shown) at the opening thereof to the auxiliary gas guide tube 8 provides for a better focussing of the gas beam of the auxiliary gas 6. With a compression of the sample gas 11 by a gas pulse of the carrier gas 3 in the sample gas guide tube 7, a constriction at the opening to the auxiliary gas tube 8 results in an increased compression of the sample gas 11 by a back-up of the sample ahead of the constriction. The constriction also provides for a delayed emptying of the sample gas guide tube 7.

The constriction of the gas beam consisting of sample gas 11 and/or the combined gas beam can be achieved in different ways. Constrictions in the form of Laval and Venturi nozzles have been found to be advantageous. Different forms of constrictions may be used for the opening of the sample gas guide tube 7 into the auxiliary gas guide tube 8 and the opening of the auxiliary gas guide tube 8 leading to the vacuum.

The device according to the invention is particularly suitable for use as a gas supply for an ion source. Because of the compression of the sample in longitudinal direction and also in a direction transverse to the gas flow direction, a high degree of sample utilization and, consequently, an increased detection sensitivity are achieved.

The device according to the invention is also advantageous for use as a gas supply for a fluorescence or an absorption spectrometer.

Also, for the generation of a pulsed aerosol beam the device according to the invention is advantageous on the basis of properties described above.

The method according to the invention is carried out by means of the described device for the generation of a directed gas beam as follows:

The device according to the invention is disposed in a vacuum chamber directly above the ion source or, respectively, the optical chamber for the photo excitation in such a way, that the distance from the excitation or, respectively, ionization volume corresponds to the distance necessary for achieving maximum cooling of the sample gas in the supersonic molecular beam (typically 3–5 cm; see R. Zimmerman, H. J. Heger, E. R. Rohwer, E. W. Schlag, A. Kettrup, V. Boesl; "Coupling of Gas Chromatography with Jet—REMPI spectroscopy and Mass Spectroscopy Symposium (RIS-96); AIP-Conference Proceedings 388; 1997; 119–122).

The gas admission lines between the device according to the invention and the vacuum: chamber are vacuum-sealed. The gas reservoir pressure for the carrier gas 3 and the auxiliary gas 6 is typically 1–10 bar (preferably 1–3 bar); the carrier gas pressure is preferably higher than the auxiliary gas pressure.

The sample gas is supplied through supply line 10 preferably in an effusive manner by way of a GC capillary (inert surface). The sample gas guide tube 7 consists preferably of a quartz glass in order to avoid catalytic processes. The sample gas 11 entering the device in an effusive manner continuously fills the sample gas guide tube 7. A control unit controls the pulse valve 4 for the gas beam of auxiliary gas 6 so as to timely open (opening duration 400 μs). The gas beam of auxiliary gas 6 fills the auxiliary gas guide tube 8. With a time delay (typically 300 μs), the pulse valve 1 for producing the carrier gas beam 3 is then opened by a second control unit. The carrier gas 3 then flows into the sample gas guide tube 7, compresses the sample gas volume in the sample gas guide tube 7 and pushes the sample gas volume downwardly, like a piston, into the auxiliary gas guide tube 8. As the opening of the sample gas guide tube 7 is located on the center axis 12 of the auxiliary gas guide tube 8, the sample gas 11 which has been compressed in the gas flow direction is disposed mainly along the center axis 12 of the gas beam including the auxiliary gas 6.

As mentioned already earlier, the constriction of the opening of the sample gas guide tube 7 in the auxiliary gas guide tube 8 provides for a smaller volume of the sample gas 11 (higher sample gas density) along the center axis 12 of the auxiliary gas beam 6 and also for a slowed emptying of the sample gas guide tube 7 by a back-up of the sample gas 11 and the carrier gas 3 in front of the constriction.

The constriction of the opening of the auxiliary gas guide tube 8 into the vacuum for example by a nozzle with a conical insert 9 provides, on one hand, the necessary pressure differential for forming a supersonic molecular beam which causes the adiabatic cooling of the sample molecules. On the other hand, the constriction provides for a radial compression of the combined gas beam. The auxiliary gas beam, which envelopes the sample gas beam 11, therefore compresses also the sample gas beam in a direction transverse to the flow direction thereby additionally focussing the sample gas beam 11 onto the center axis 12 of the auxiliary gas beam. As a result, a rapid spatial expansion of the sample gas beam 11 during the expansion into the vacuum is prevented and a high sample gas density in the ionization volume is achieved (high detection sensitivity).

For the examination of the cooling properties in the supersonic molecular gas beam benzene is particularly suitable as a sample gas 11. In order to achieve good cooling, argon or helium is used as the carrier gas 3 or respectively, the auxiliary gas 6.

If the carrier gas pressure is higher than the auxiliary gas pressure the sample gas 11 can be more easily injected into the auxiliary gas 6. As a result, a time-wise shorter sample gas pulse can be formed in the auxiliary gas beam 6.

In order to achieve an optimal time correlation between the opening of the carrier gas pulse valve 1, the delay time between the opening of the auxiliary gas pulse valve 4 and the opening of the carrier gas pulse valve 1 is varied and the respective REMPI-signal (ionization yield) is recorded while the laser wavelength (excitation wavelength for the $S_1 \leftarrow S_o$-transition of benzene) is maintained constant. From the location of the maximum of the REMPI signal the optimal time correlation between the opening of the auxiliary gas pulse valve 4 and the opening of the carrier gas pulse valve 1 can be determined.

Figure 2:
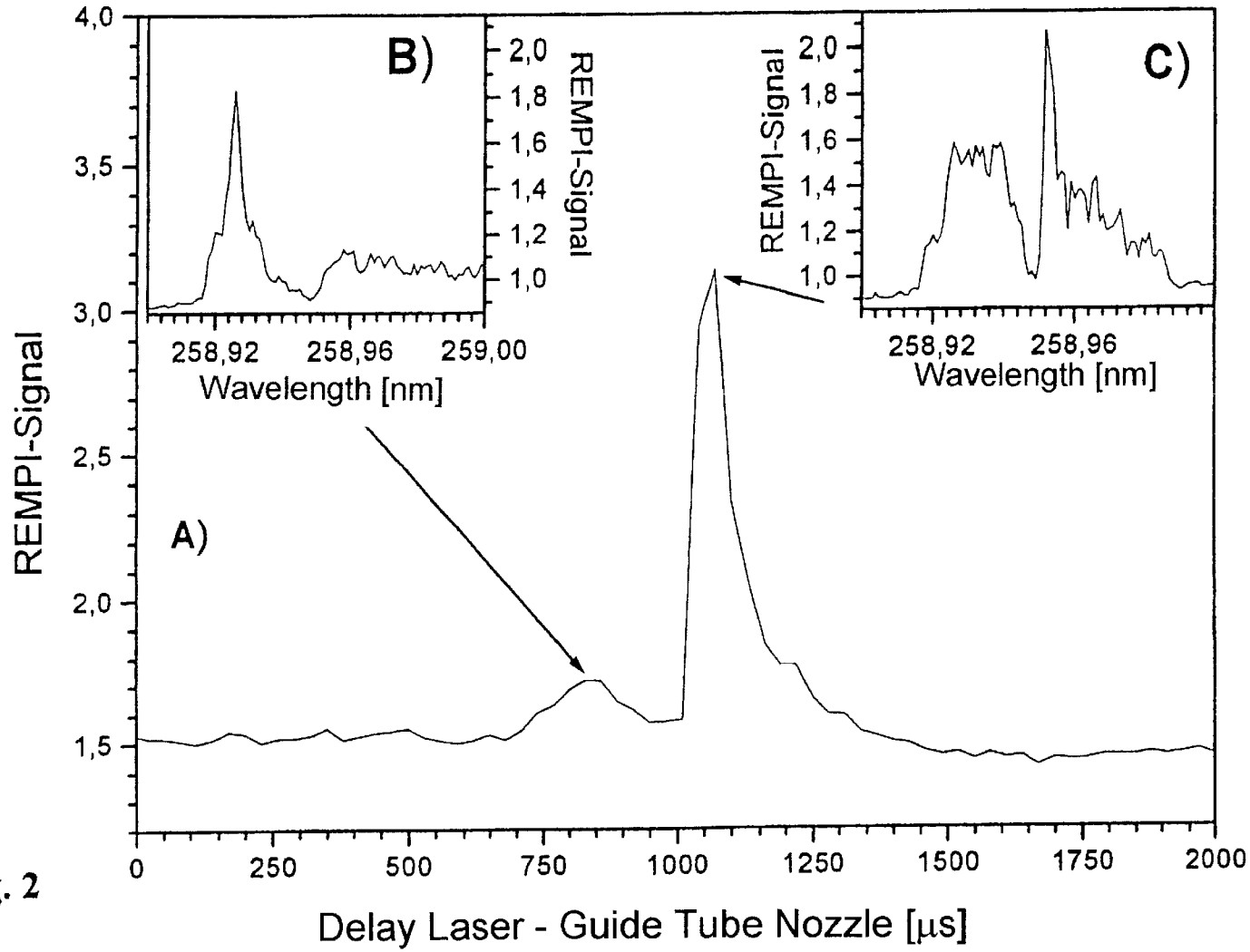
FIG. 2*a* shows a spectrum for benzene obtained with the device shown in FIG. 1, FIGS. 2*b* and 2*c* show the rotation contours of the 6°-bands of benzene at two different delay times of FIG. 2*a* from which the rotation temperature of the benzene sample at those delay times can be determined.

For the optimal time correlation between the laser pulse for the ionization and the two gas pulses 6, 3, the time delay of the laser pulse with respect to the gas pulses is varied while the (optimal) correlation between the opening of the pulse valves 4 and 1 is maintained. In this way, the signal values as represented in FIG. 2A are obtained. FIG. 2A shows, on the base the delay time of the laser pulse, in microseconds, with respect to the opening of the auxiliary gas pulse valve 4 and, on the ordinate, the respective REMPI signal in arbitrary units. In addition to the actual signal maximum at 1070 μs, which is the result of the compressed sample gas pulse, another smaller signal peak can be noted at a delay time of 850 μs. FIG. 2B shows the rotation contour of the $6°_1$ bands of benzene recorded at the signal maximum at 1070 μs delay time. FIG. 2C shows the rotation contour of the $6_1°$ bands of benzene recorded at a delay time of 850 μs (small signal peak). Both figures show on the base the laser wave length in nanometers and, on the ordinate, the respective REMPI signal in arbitrary units. Because of the rotation contour of FIG. 2C, the sample can be assigned at the signal maximum (delay time 1070 μs) a rotation temperature of about 15° K whereas the rotation temperature shown in FIG. 2B is that of an uncooled sample. Rotation temperatures of a few °Kelvin as they or present with a delay time of 1070 μs permit in many cases an isomer-selective detection of individual target compounds, whereas, with higher rotation temperatures (FIG. 2B), the molecule bands overlap to such a degree that, generally, only whole classes are detected.

With a rapid control for a test procedure, it would therefore be possible with the device according to the invention to vary the delay time of the laser between the individual laser pulses or after several laser pulses in such a way that alternatively measurements are made in an isomer-selective (in the signal maximum) and class-selective manner (at the smaller signal peak) manner. It would be possible in this way to detect, with a single measuring procedure, environment relevant target compounds even though they are overlapped by several isomers of the compound (for example, benzo[a] pyrene out of all the benzo-pyrenes) in an isomer-selective manner and, at the same time, to obtain an overview over the complete compound classes (for example all PAK in an exhaust gas of an industrial combustion plant).

What is claimed is:

1. A method for producing a directed gas jet, comprising the following steps:

a) generating a guided sample gas beam b) generating an auxiliary gas beam which is directed and guided in the same direction as, but extends separately from, said sample gas beam, c) providing a pulsed carrier gas beam and combining it with said sample gas beam such that said sample gas is embedded in said carrier gas beam in axially spaced pulses which are axially compressed by said carrier gas, and combining said sample gas beam and said auxiliary gas beam over a certain distance.

2. A method according to claim 1, wherein also said auxiliary gas beam is pulsed.

3. A method according to claim 1, wherein, after said certain distance of combined gas flow, said combined gas flow is radially constricted.

4. A method according to claim 2, wherein said pulses are controlled so as to provide a correlation between the carrier gas pulses and the auxiliary gas pulse.

5. A method according to claim 3, wherein, after the radial constriction of said gas beam, the gas is expanded so as to be adiabatically cooled thereby.

6. A method according to claim 1, wherein said sample gas beam is constricted before its combination with the auxiliary gas beam.

7. A method according to claim 3, wherein said gas beam is constricted by Laval or Venturi nozzles.

8. A device for producing a directed gas jet from a sample gas beam embedded in an auxiliary gas beam, said device including a central sample gas guide tube, an auxiliary gas guide tube disposed concentrically around said central sample gas tube, said sample gas guide tube having an end with an opening disposed within said auxiliary gas guide tube, means for admitting a sample gas to said sample gas guide tube and means for admitting an auxiliary gas to said auxiliary gas guide tube and including a pulsed valve for controlling the admission of said auxiliary gas to the auxiliary gas guide tube.

9. A device according to claim 8, wherein said auxiliary gas guide tube has a constriction at its open end downstream of said auxiliary gas guide tube.

10. A device according to claim 8, wherein said means for admitting a sample gas to said sample gas guide tube includes a radial sample gas supply line and said sample gas guide tube includes, at its upstream end, a pulse valve for admitting carrier gas pulses to said sample gas guide tube for providing compressed sample gas pulses between said carrier gas pulses.

11. A device according to claim 10, wherein said pulse valves are controllable by a programmable control unit for controlling the timing correlation of the carrier gas pulses and the auxiliary gas pulses.

12. A device according to claim 8, wherein said sample gas guide tube has a constriction at its open end in said auxiliary gas guide tube.

13. A device according to claim 12, wherein said constrictions in said auxiliary gas guide tube and said sample gas guide tube are either one of a Laval and Venturi nozzle.

14. A device according to claim 8, wherein said device is a gas inlet structure of an ion source.

15. A device according to claim 8, wherein said device is a gas inlet structure of a fluorescence or absorption spectrometer.

16. A device according to claim 8, wherein said device is a gas inlet structure of a pulsed aerosol beam.

* * * * *